US006963708B2

(12) United States Patent
Sekovski et al.

(10) Patent No.: US 6,963,708 B2
(45) Date of Patent: Nov. 8, 2005

(54) CHARGING SYSTEM UTILIZING GRID ELEMENTS WITH DIFFERENTIATED PATTERNS

(75) Inventors: David Sekovski, Rochester, NY (US); Paul F. Sawicki, Rochester, NY (US); John D. McCaffrey, Rochester, NY (US)

(73) Assignee: Xerox Corporation, Stamford, CT (US)

( * ) Notice: Subject to any disclaimer, the term of this patent is extended or adjusted under 35 U.S.C. 154(b) by 144 days.

(21) Appl. No.: 10/654,785

(22) Filed: Sep. 4, 2003

(65) Prior Publication Data

US 2005/0053397 A1 Mar. 10, 2005

(51) Int. Cl.[7] ..... G03G 15/02
(52) U.S. Cl. ..... 399/171
(58) Field of Search ..... 399/169, 170, 399/171, 173; 250/324–326; 361/225

(56) References Cited

U.S. PATENT DOCUMENTS 4,603,964 A 8/1986 Swistak
4,725,732 A 2/1988 Lang et al. ..... 250/326
4,876,578 A * 10/1989 Hara et al. ..... 399/171
4,974,032 A * 11/1990 Hara et al. ..... 399/171
5,025,155 A * 6/1991 Hattori ..... 250/326
5,250,992 A 10/1993 Tsuneeda et al.
5,266,428 A 11/1993 Russell
5,300,986 A 4/1994 Mishra et al.
5,351,111 A * 9/1994 Takafuji et al. ..... 399/171
5,666,604 A * 9/1997 Nakagami et al. ..... 399/173
5,687,297 A 11/1997 Coonan et al. ..... 395/102
6,069,624 A 5/2000 Dash et al. ..... 345/333
6,459,873 B1 10/2002 Song et al. ..... 399/171
2001/0046394 A1 11/2001 Yamanaka et al.

OTHER PUBLICATIONS

European Search Report.

* cited by examiner

*Primary Examiner*—William J. Royer
(74) *Attorney, Agent, or Firm*—Oliff & Berridge, PLC

(57) ABSTRACT

A charging system for uniform charging of charge retentive surfaces such as photoreceptors in imaging systems. The charging system includes corona producing elements and grid elements such as scorotron screens wherein the grid elements are arranged generally parallel to each other and have differentiated grid feature patterns. The differentiated grid feature patterns enable more uniform charging.

18 Claims, 5 Drawing Sheets

PRIOR ART

PRIOR ART

CHARGING SYSTEM UTILIZING GRID ELEMENTS WITH DIFFERENTIATED PATTERNS

FIELD OF THE INVENTION

The present invention relates generally to charging devices and in particular to charging devices that include grid elements such as scorotron charging devices used in imaging systems.

BACKGROUND AND SUMMARY

In electrostatographic-type copiers and printers in common use, a charged imaging member such as a photoconductive insulating layer of a photoreceptor may be electrically charged and thereafter exposed to a light image of an original document or a laser exposure of a digitally stored document. The exposure discharges the photoconductive insulating surface in exposed or background areas and creates an electrostatic latent image on the member which corresponds to the image areas contained within the original document. Subsequently, the electrostatic latent image on the photoconductive insulating surface is made visible by developing the image with toner. During development, the toner particles are attracted from carrier particles by the charge pattern of the image areas on the photoconductive insulating surface to form a powder image on the photoconductive insulating surface. This image may be subsequently transferred to a support surface such as a copy substrate to which it may be permanently affixed by heating or by the application of pressure. Following transfer of the toner image to the support surface, the photoconductive insulating surface may be discharged and cleaned of residual toner to prepare for the next imaging cycle. The imaging processes described above are well known in the art.

Various types of charging devices have been used to charge or precharge charge retentive surfaces such as the photoconductive insulating layers of photoreceptors or such as copy substrates prior to transfer of toner images. These charging devices include corotrons, dicorotrons, pin corotron, scorotron, discorotron, and pin scorotron. See, generally, R. M. Schaffert, "Electrophotography," The Focal Press, New York, 1965.

A scorotron device, included within the list above, it typically comprised of one or more corona wires or pin arrays with a conductive control grid or screen of parallel wires or apertures in a charge plate positioned between the corona producing element and the photoreceptor. A potential is applied to the control grid of the same polarity as the corona potential but with a much lower voltage, usually several hundred volts, which suppresses the electric field between the charge plate and the corona wires and markedly reduces the ion current flow to the photoreceptor.

The pin array variety of scorotron has proved to be a particularly inexpensive, durable, and effective device. Pins are often formed by forming "saw teeth" in a conductive metal sheet mounting these saw teeth edgewise facing the scorotron grid. In this arrangement, however, certain difficulties have been observed. One such difficulty is a sinusoidal wave pattern of charging thought to result from the increased charge potential located at the peaks of each pin when compared to each "valley" between pins. The scorotron grid is known to ameliorate the problem by diffusing the charge pattern through the grid pattern. Another method of ameliorating this problem is using at least two pin arrays arranged in parallel fashion such that the peaks of pins in the first array align with the valleys of the second array along the imaging path. Use of conventional scorotron grids with such dual pin arrays is known to produce charge uniformity across a process width of about plus or minus 25 volts for mid-range process speeds. In high quality printing, however, even relatively minor fluctuations in charge potential across the charged imaging surface, such as plus or minus 25 volts, cause undesirable printing irregularities.

A typical prior art scorotron device with dual pin arrays and a scorotron grid is shown in FIG. 1 (FIG. 1 is adapted from U.S. Pat. No. 4,725,732 which is hereby incorporated herein in its entirety.) In this perspective exploded view, scorotron charging device 100 is shown with two spaced apart, generally parallel pin arrays, 200 and 202, each supported on support projections 204. The distance between arrays 200 and 202 is chosen to be as large as possible consistent with the need for a compact device since smaller spacing between the arrays results in the need to increase power levels to drive the scorotron. Locator pin 208 is provided to correctly position pin array 202 while another locator pin (not shown) positions pin array 200 in a position offset by a spacing of ½pitch in order that each peak of pin array 200 laterally corresponds to a valley of pin array 202 and vice versa. Frame members 206, 238, 212, 230, and 214 contain the corona field emitted from pin arrays 200 and 202 while providing support and means for mounting the arrays. Scorotron grid member 247 attaches to appropriate frame members. Openings in grid member 247 enable the corona field to emerge from charging device 100 and to interact with the charge retentive elements of a charged imaging surface (not shown). Electrically insulated wire 222 conducts charging DC current to pin arrays 200 and 202 while insulated wire 220 conducts regulating current to grid member 247.

As shown in FIG. 2, charging device 100 is assembled into printing system 300. Typical uses within printing system 300 include charging of any charge retentive surface such as that of a photoreceptor 301 as shown in FIG. 2 or other imaging surface prior to image development as well as charging of a copy substrate 302 prior to toner transfer as well as detaching of the copy substrate 302 after toner transfer. Printing system 300 may be any number of electrostatographic imaging systems including, without limitation, electrophotographic monochrome or color systems and including without limitation printers, copiers, and various multifunctional systems.

One approach to improving charge uniformity using scorotron charging devices is set forth in U.S. Pat. No. 6,459,873, issued to Song et al., where a pair of scorotrons cooperatively charge the charged imaging surface. The first scorotron device initially charges the imaging surface to an intermediate overshoot voltage and the second scorotron device thereafter uniformly charges the imaging surface to the final voltage. Improved uniformity is created because the first scorotron device provides a generally high percent open control grid area (a range above 70% is claimed in Song) while the second scorotron device provides a generally lower percent open grid area (a range below 70% is claimed in Song). The higher percent of opening in the first scorotron grid correlates to a greater rate of charging, or slope, while the smaller percent of scorotron grid opening correlates to a lesser slope, or lesser rate of charging. The lesser slope of the second scorotron device enables more precise control of the charging process and, as a result, greater uniformity. Song is hereby incorporated herein by reference in its entirety.

The dual scorotron device taught in Song improves charge uniformity due to the differential in percentage of openings between the first and second grids. It would be desirable, however, to further improve charging uniformity.

One embodiment of the invention is a charging system for charging a charge retentive surface, comprising: at least one corona producing element, spaced from the charge retentive surface and arranged generally along the width dimension; and grid elements, interposed between said corona producing element and the charge retentive surface, wherein the grid elements are arranged generally parallel to each other along the width dimension and comprise differentiated grid feature patterns.

Another embodiment of the invention is an electrostatographic imaging system, comprising: a charge retentive surface having a width dimension; at least one corona producing element, spaced from the charge retentive surface and arranged generally along the width dimension; and grid elements, interposed between the corona producing element and the charge retentive surface, wherein the grid elements are arranged generally parallel to each other along the width dimension and comprise differentiated grid feature patterns.

Yet another embodiment of the invention is a method for charging a charge retentive surface having a width dimension, comprising: electrically charging at least one corona producing element, spaced from the charge retentive surface and arranged generally along the width dimension, sufficiently to emit a corona field; affecting the corona field by interposing, between the corona producing element and the charge retentive surface, grid elements that are arranged generally parallel to each other along the width dimension and that comprise differentiated grid feature patterns.

BRIEF DESCRIPTION OF THE DRAWINGS

The invention may take physical form in certain parts and arrangements of parts, an embodiment of which will be described in detail in this specification and illustrated in the accompanying drawings which form a part hereof, and wherein.

DESCRIPTION

Figure 1:
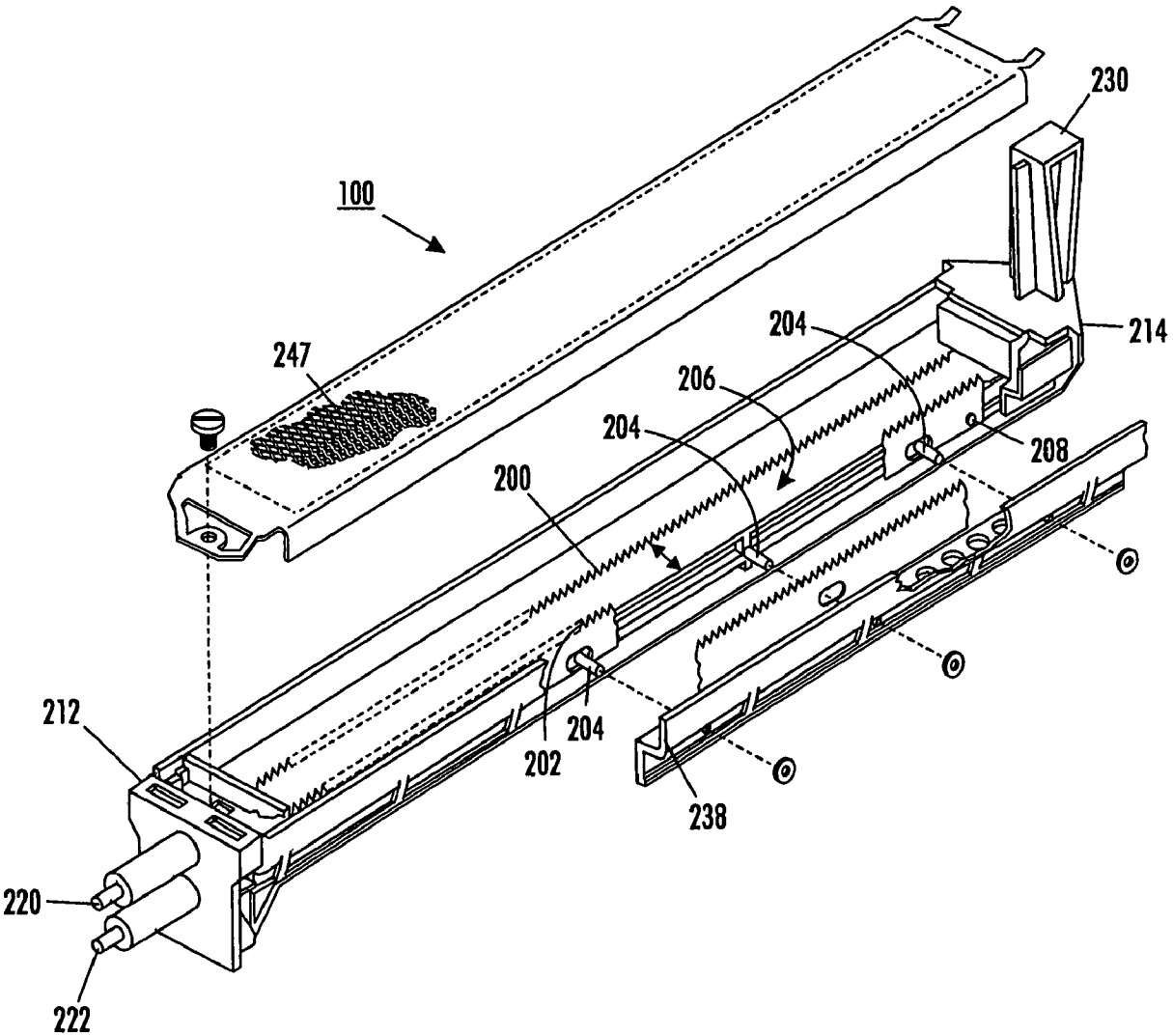
FIG. 1 is a perspective exploded and section view of a scorotron system of the prior art.
Figure 2:
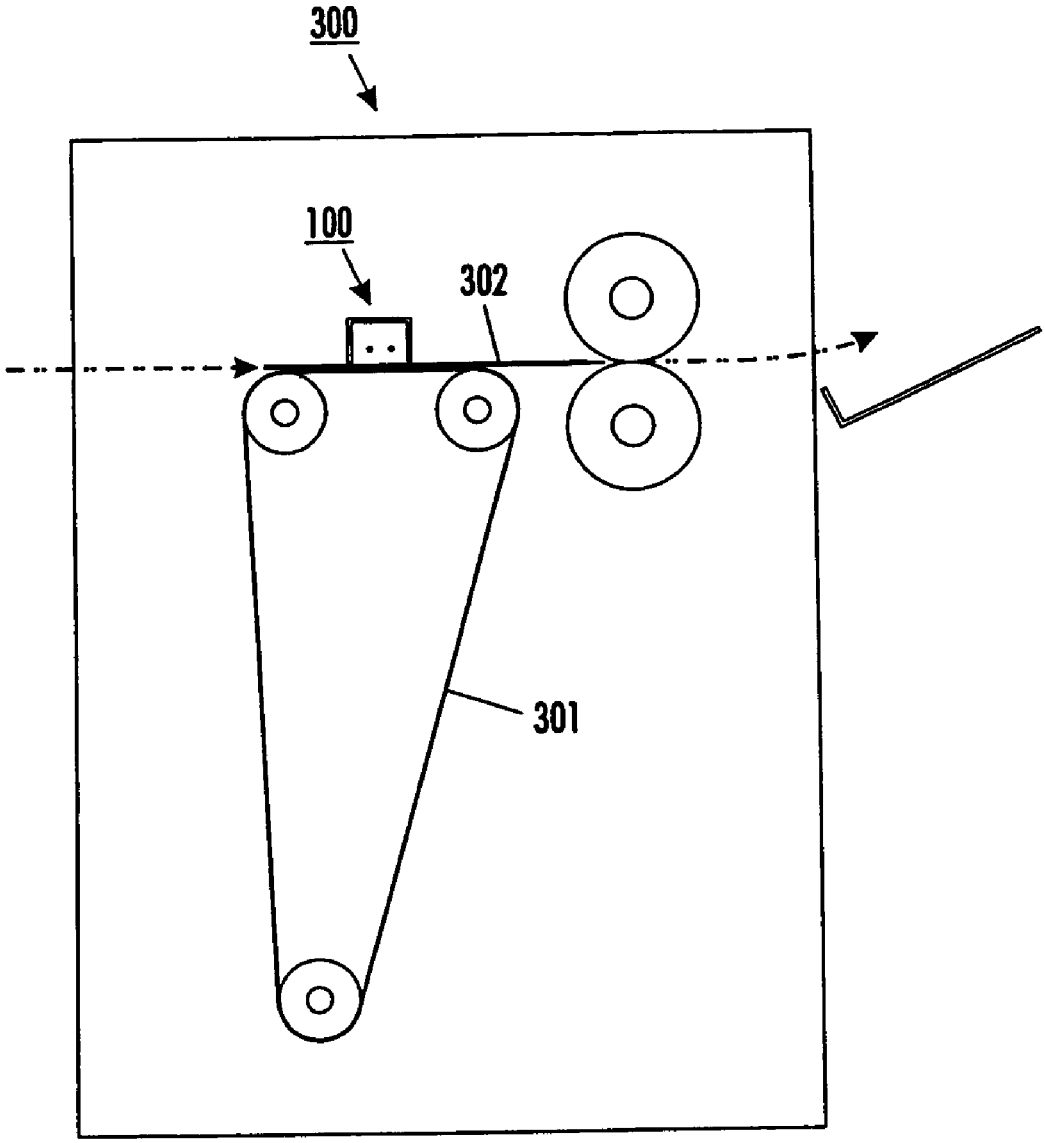
FIG. 2 is a schematic drawing of an exemplary imaging system embodying a scorotron system.

For a general understanding of the present invention, reference is made to the drawings. In the drawings, like reference numerals have been used throughout to designate identical elements.

An exemplary electrostatographic system comprising an embodiment of the present invention is a multifunctional printer with print, copy, scan, and fax services. Such multifunctional printers are well known in the art and may comprise print engines based upon electrophotography and other imaging electrostatographic technologies. The general principles of electrophotographic imaging are well known to many skilled in the art. Generally, the process of electrophotographic reproduction is initiated by substantially uniformly charging a photoreceptive member, followed by exposing a light image of an original document thereon. Exposing the charged photoreceptive member to a light image discharges a photoconductive surface layer in areas corresponding to non-image areas in the original document, while maintaining the charge on image areas for creating an electrostatic latent image of the original document on the photoreceptive member. This latent image is subsequently developed into a visible image by a process in which a charged developing material is deposited onto the photoconductive surface layer, such that the developing material is attracted to the charged image areas on the photoreceptive member. Thereafter, the developing material is transferred from the photoreceptive member to a copy sheet or some other image support substrate to which the image may be permanently affixed for producing a reproduction of the original document. In a final step in the process, the photoconductive surface layer of the photoreceptive member is cleaned to remove any residual developing material therefrom, in preparation for successive imaging cycles.

The above described electrophotographic reproduction process is well known and is useful for both digital copying and printing as well as for light lens copying from an original. Since electrophotographic imaging technology is so well known, further description is not necessary. See, for reference, e.g., U.S. Pat. No. 6,069,624 issued to Dash, et al. and U.S. Pat. No. 5,687,297 issued to Coonan et al., both of which are hereby incorporated herein by reference.

Figure 3:
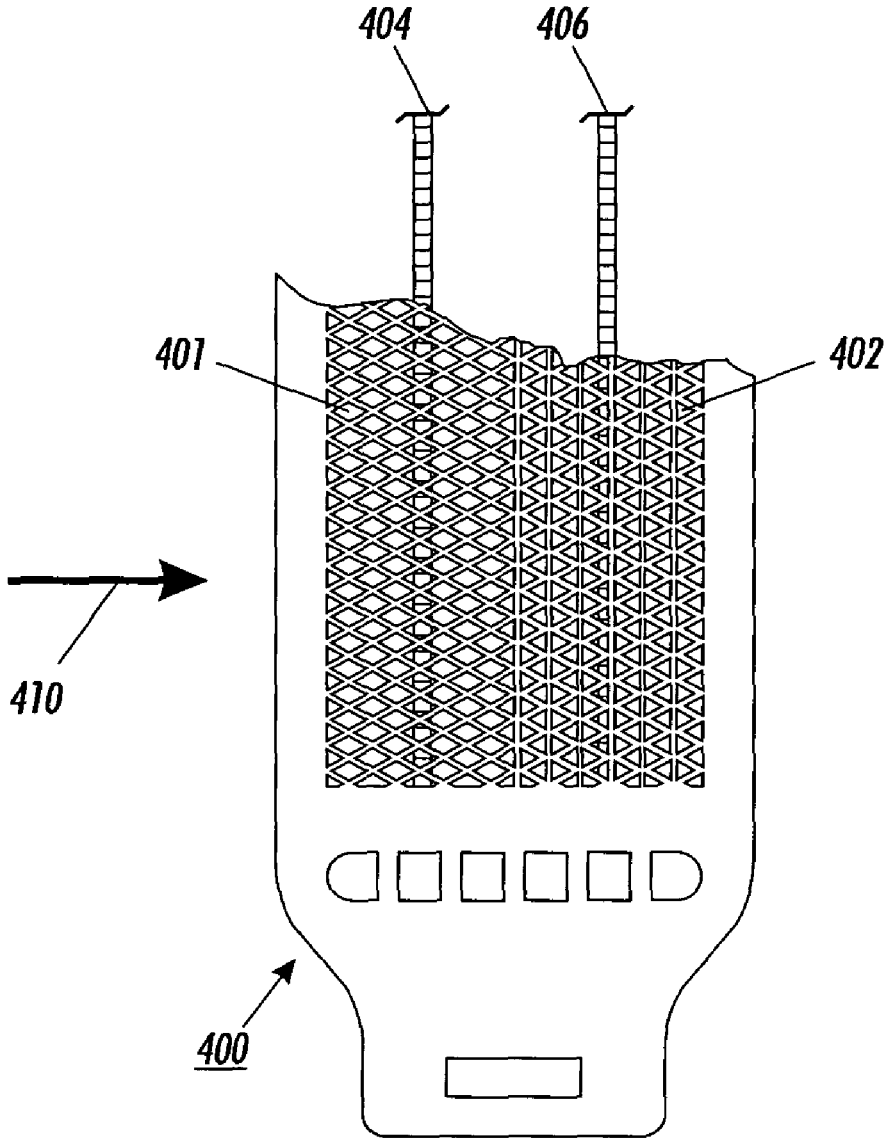
FIG. 3 is a raised perspective view of an embodiment of the invention having one grid with a plurality of differentiated patterns.

Referring now to FIG. 3, one embodiment of the invention is shown in the form of scorotron grid 400. As shown, grid 400 contains two major shapes of openings. In region 401, the pattern comprises an intersecting set of diamonds. Approximately at the mid-line of grid 400, the feature pattern transitions to a triangular shape of region 402. In the embodiment shown, the percent opening of the grid 400 is greater than 70 percent in region 401 and less than 70 percent in region 402. Pin array 404 emits a corona charge primarily affected by region 401 while pin array 406 emits a corona charge primarily affected by region 402. Since pin arrays 404 and 406 are staggered by ½pitch, grid 400 combines into one scorotron device three separate means for rendering scorotron corona fields more uniform: 1) the pin arrays 404 and 406 are staggered by ½pitch; 2) the percent openings in grid 400 vary by percent; and 3) the feature pattern of the grid wires themselves is altered. Since the substrate path, as indicated by arrow 410, takes the imaging width of the substrate (not shown) past both regions 401 and 402, the result is more uniform charging than if the same feature pattern were used in region 401 and in region 402.

Figure 4:
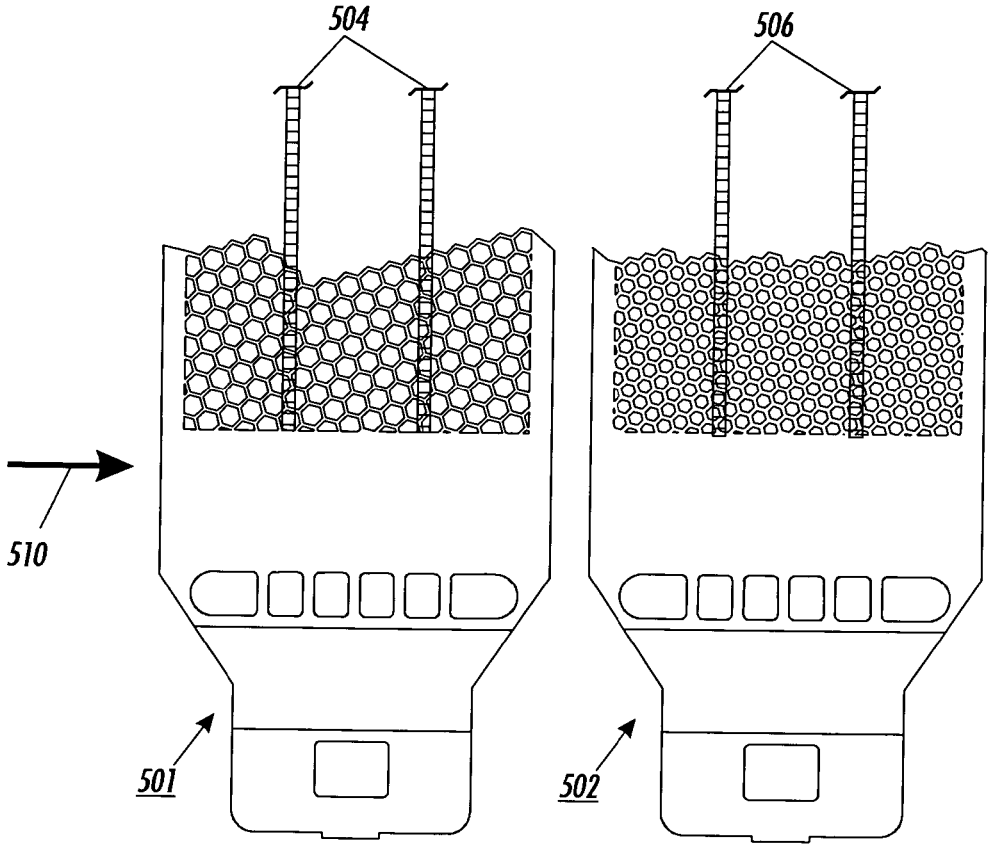
FIG. 4 shows a raised perspective view of two scorotron grids operating cooperatively in a two scorotron device system.

Referring to FIG. 4, a second of many possible embodiments of the invention is shown in the form of dual scorotron grids 501 and 502 indicating two separate scorotron devices. Placed side-by-side across the width dimension of the substrate path indicated by arrow 510, the dual scorotron devices may function in the manner described above in relation to U.S. Pat. No. 6,459,873, issued to Song et al. Grid 501, having at least a 70 percent opening, is intended to operate as part of a scorotron charging device having a high slope. Grid 502, having about a 50 percent opening, is intended to operate as part of a scorotron charging device having a lower slope. Together, they operate to bring the charged imaging substrate (not shown) to the desired charging potential, with the scorotron charging device 504 associated with grid 501 delivering the majority of the charging potential and the scorotron charging device 506 associated with grid 502 providing a lesser charge while leveling any charge non-uniformity.

As seen in FIG. 4, the grid feature patterns in grid 501 differs from the grid pattern in grid 502. Whereas the grid feature patterns in FIG. 3 differed due to varying geometric shapes, the grid feature patterns in FIG. 4 both have the same geometric shape but differ in feature size. Specifically, the mesh of grid 501 is comprises of mesh wire 0.3±0.07 millimeters wide with each hexagon being 2.0±0.1 millimeters across. As shown, this combination results in a 1.73 millimeter distance between two parallel lines that each are orthogonal to a hexagon side and that intersect the centers of two adjoining hexagons. In contrast, comparable measurements of the embodiment shown as grid 502 are 0.41±0.07 for mesh wire size, 1.5±0.1 millimeters for hexagon size, and 1.3 millimeters between comparable parallel lines intersecting the centers of adjoining hexagons.

Figure 5:
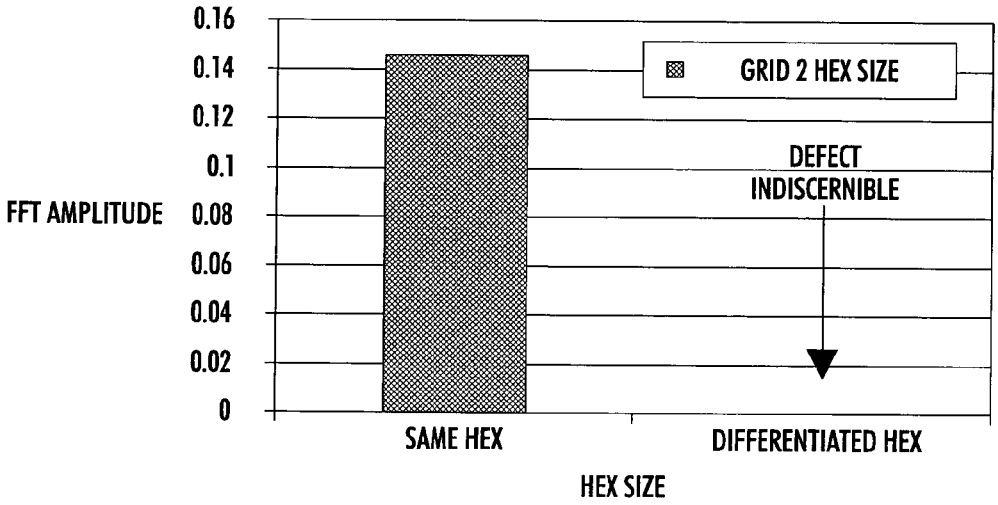
FIG. 5 is a bar chart comparing charge uniformity achievable with one embodiment of the invention with charge uniformity achieved with a comparable scorotron system without the advantages of the present invention.

The impact upon charging uniformity of using scorotron grid elements having differentiated patterns is shown in the bar charge of FIG. 5. In this Figure, results using two scorotron grid element arrangements are compared. In both arrangements, two scorotron charging devices were mounted side-by-side in a manner similar to that shown in FIG. 4. In both instances, the first scorotron grid of the first scorotron device in the pair corresponded to the grid parameters of grid 501 shown in FIG. 3, i.e., 70% hexagonal openings. For the bar labeled "Same Hex", the second scorotron grid utilized the same 1.73 millimeter feature spacing between parallel lines intersecting adjoining hexagon centers but used thicker wire mesh to reduce the openings to fifty (50) percent openings. In other words, the feature pattern was the same size but the line thickness was greater within each feature. For the bar labeled Different Hex, the dimensions of grid 502 from FIG. 4 were used. In other words, both scorotron sets were identical 70:50 percent grid opening pairs but the "Different Hex" achieved its 50% opening grid using a different scorotron grid feature pattern while the "Same Hex" used the identical size and shape hexagon in both first and second grids.

The results confirm the advantages of using different grid patterns. Whereas the bar in FIG. 5 corresponding to the "Same Hex" grid configuration shows detectable charging non-uniformities in excess of 0.14 L* amplitude as measured in 1976 CIE L*a*b space. The bar corresponding to the "Different Hex" grid configuration showed no discernible defects.

In sum, use of scorotron grid elements having differentiated grid patterns across the width dimension of an imaging substrate result in more uniform charging of the charge retentive surface. Embodiments of the invention apply to charging systems utilizing grids positioned between the charge retentive surface and the corona generating elements. Such charging systems include, without limitation, wire-based scorotrons, pin-array scorotrons, and discorotrons. Pin array scorotrons become particularly attractive with embodiments of the invention by combining the high charge uniformity achievable with the present invention with the relative inexpensiveness and robustness of pin array corona devices. Differentiated patterns can be achieved in any manner, including varying the grid pattern by geometric shape or by feature size.

While particular embodiments have been described, alternatives, modifications, variations, improvements, and substantial equivalents that are or may be presently unforeseen may arise to applicants or others skilled in the art. Accordingly, the appended claims as filed and as they may be amended are intended to embrace all such alternatives, modifications variations, improvements, and substantial equivalents.

What is claimed is:

1. A charging system for charging a charge retentive surface having a width dimension, comprising:

at least one corona producing element, spaced from the charge retentive surface and arranged generally along the width dimension; and grid elements, interposed between said at least one corona producing element and the charge retentive surface, wherein the grid elements are arranged generally parallel to each other along the width dimension and comprise differentiated grid feature patterns, where the differentiated grid feature patterns comprise the same geometric shape having a plurality of grid mesh opening sizes, and wherein each geometric shape has a center point of its opening and wherein the distance between a first set of parallel lines, each line of which intersects the center point of adjoining shapes of a first grid feature pattern, differs from the distance between a second set of parallel lines, each line of which intersects the center point of adjoining features of a second grid feature pattern and each line of which has the same orientation to the shapes of the second grid feature pattern as the orientation of the first set of parallel lines to the shapes of the first feature pattern.

2. The charging system of claim 1, wherein the differentiated grid feature patterns comprise a plurality of geometric shapes.

3. The charging system of claim 2, wherein the plurality of geometric shapes comprise triangular and diamond shapes.

4. The charging system of claim 1, wherein the differentiated grid feature patterns comprise the same geometric shape having differentiated feature sizes.

5. The charging system of claim 1, wherein the differentiated grid feature patterns comprise hexagonal patterns of differentiated sizes.

6. The charging system of claim 1, further comprising a frame enclosure arranged generally around the at least one corona producing elements wherein said grid elements comprise essentially one side of the enclosure.

7. The charging system of claim 6, wherein the at least one corona producing element comprises a plurality of elements arranged within a plurality of frame enclosures.

8. The charging system of claim 7, wherein each of said grid elements attach to separate frame enclosures.

9. The charging system of claim 7, wherein each frame enclosure encloses a plurality of corona producing elements.

10. The charging system of claim 1, wherein the charging system comprises a scorotron charging system.

11. The charging system of claim 1, wherein the at least one corona producing element comprises a pin array corona producing device.

12. An electrostatographic imaging system, comprising:

a charge retentive surface having a width dimension;

at least one corona producing element, spaced from the charge retentive surface and arranged generally along the width dimension; and grid elements, interposed between the at least one corona producing element and the charge retentive surface, wherein the grid elements are arranged generally parallel to each other along the width dimension and comprise differentiated grid feature patterns, where the differentiated grid feature patterns comprise the same geometric shape having a plurality of grid mesh opening sizes, and wherein each geometric shape has a center point of its opening and wherein the distance between a first set of parallel lines, each line of which intersects the center point of adjoining shapes of a first grid feature pattern, differs from the distance between a second set of parallel lines, each line of which intersects the center point of adjoining features of a second grid feature pattern and each line of which has the same orientation to the shapes of the second grid feature pattern as the orientation of the first set of parallel lines to the shapes of the first feature pattern.

13. The electrostatographic imaging system of claim 12, wherein the charge retentive surface is a photoreceptor.

14. A method for charging a charge retentive surface having a width dimension, comprising:

electrically charging at least one corona producing element, spaced from the charge retentive surface and arranged generally along the width dimension, sufficiently to emit a corona field;

affecting the corona field by interposing, between the at least one corona producing element and the charge retentive surface, grid elements that are arranged generally parallel to each other along the width dimension and that comprise differentiated grid feature patterns, where the differentiated grid feature patterns comprise the same geometric shape having a plurality of grid mesh opening sizes, and wherein each geometric shape has a center point of its opening and wherein the distance between a first set of parallel lines, each line of which intersects the center point of adjoining shapes of a first grid feature pattern, differs from the distance between a second set of parallel lines, each line of which intersects the center point of adjoining features of a second grid feature pattern and each line of which has the same orientation to the shapes of the second grid feature pattern as the orientation of the first set of parallel lines to the shapes of the first feature pattern.

15. The method of claim 14, wherein the differentiated grid feature patterns comprise a plurality of geometric shapes.

16. The method of claim 14, wherein the differentiated grid feature patterns comprise the same geometric shape having differentiated sizes.

17. The method of claim 14, wherein a frame enclosure is arranged generally around the at least one corona producing element wherein said grid elements comprise essentially one side of the enclosure.

18. The method of claim 17, wherein each of the grid elements attach to separate frame enclosures.

* * * * *